US007205712B2

(12) United States Patent
Yan

(10) Patent No.: US 7,205,712 B2
(45) Date of Patent: Apr. 17, 2007

(54) SPIRAL COLD CATHODE FLUORESCENT LAMP

(75) Inventor: Ellis Yan, Auburn, OH (US)

(73) Assignee: Technical Consumer Products, Inc., Aurora, OH (US)

( * ) Notice: Subject to any disclaimer, the term of this patent is extended or adjusted under 35 U.S.C. 154(b) by 279 days.

(21) Appl. No.: 10/852,939

(22) Filed: May 26, 2004

(65) Prior Publication Data

US 2005/0264163 A1 Dec. 1, 2005

(51) Int. Cl.
*H01J 1/62* (2006.01)
*H01J 63/04* (2006.01)

(52) U.S. Cl. ..... 313/493; 313/553; 313/558; 313/561; 313/481

(58) Field of Classification Search ..... 313/493, 313/553, 558, 559, 573, 574, 631, 632, 634, 313/549, 561, 481; 417/48, 51
See application file for complete search history.

(56) References Cited

U.S. PATENT DOCUMENTS 2,249,672 A * 7/1941 Spanner ..... 445/17
4,315,187 A * 2/1982 Chow ..... 313/558
5,256,935 A 10/1993 Dobashi et al.
5,610,477 A * 3/1997 Ivanov et al. ..... 313/573
6,064,155 A 5/2000 Maya et al.
6,515,433 B1 2/2003 Ge et al.
6,646,365 B1 11/2003 Denissen et al.
6,759,797 B2 * 7/2004 Tokes et al. ..... 313/318.01
2002/0135299 A1 * 9/2002 Chow ..... 313/558

* cited by examiner

*Primary Examiner*—Ashok Patel
(74) *Attorney, Agent, or Firm*—Joseph H. Taddeo

(57) ABSTRACT

A light tube for a cold cathode fluorescent lamp includes a light tube body, anode and cathode disposed in the light tube body and an activated gas absorber. The light tube body contains inert gas, mercury substance and a layer of phosphor coating on its inner surface. The cathode is adapted for electrically connecting to the negative terminal for emitting electrons to excite the mercury substance for conducting the electrons to the anode as an electric circuit, wherein the excited mercury substance emits ultra violet rays causing the phosphor coating to generate visible light. The activated gas absorber is gas absorber made of zirconium-aluminum alloy which can be activated at an activation temperature substantially lower than 900 degrees Celsius, preferably 390 degrees Celsius, to provide stronger oxygenic gas absorption ability while reducing the manufacturing steps and cost.

19 Claims, 6 Drawing Sheets

SPIRAL COLD CATHODE FLUORESCENT LAMP

FIELD OF INVENTION

The present invention relates primarily to a spirally wound cold cathode fluorescent lamp, and more particularly to a spirally wound cold cathode fluorescent lamp whose cathode is coated with a layer of a gas absorbent alloy for slowing the oxidizing decay rate of the cathode.

BACKGROUND OF THE INVENTION

A compact fluorescent lamp (CFL) is widely used for lighting. A conventional CFL includes a light tube, having a phosphor coating on its inner surface, and containing an inert gas and mercury substance, where the mercury is in the form of mercury vapor or liquid mercury. The light tube is enclosed with caps at its two ends, at which a cathode and anode are disposed therein. When enough electric voltage is applied to the cathode and anode, the cathode emits electrons and causes the mercury to discharge, thereby conducting the electric current to the anode. In the course of discharge, the mercury emits ultraviolet rays that excite the phosphor coating to generate visible light. The cathode is usually shaped as a wire having a diameter of about one millimeter. In order to electrically excite the mercury to emit ultraviolet rays, the cathode is usually required to operate at a temperature approximating 800 degrees Celsius.

A cold cathode fluorescent lamp (CCFL) has a basic structure similar to CFL in the sense that they all need a light tube with a phosphor coated inner layer that contains an inert gas, a mercury substance, and a cathode electrically connected to a power source for exciting the mercury. The CCFL differs from the CFL in the sense that the cathode of the CCFL has a larger surface area and a lower functioning temperature. The cathode of the CCFL is usually shaped as a single or multiple layers of plates, such that its surface area is larger than the wire-shaped cathode of a CFL. Additionally, only a temperature about 100 degrees Celsius is required for the cathode of a CCFL to function. Thus the name "cold cathode" is given to the CCFL when comparing it to the traditional cathode fluorescent lamp.

Because the cold cathode functions at a lower temperature, the life span of the CCFL usually lasts longer than its comparative models of CFL. Moreover, the CCFL can better survive an impact force than does the CFL, because it is easier for the impact force to disconnect the wire-shaped cathode of CFL from the power source than to disconnect the plate shaped cathode from the same.

The following prior art discloses the various aspects in the design of spirally shaped cold cathode fluoresent lamps.

U.S. Pat. No. 5,256,935, granted Oct. 26, 1993, to Y. Dobashi et al., discloses a cold cathode mercury vapor discharge lamp that includes a bulb, a support wire within the bulb, and a cathode electrode having a pair of V-shaped electrode portions mounted in spaced, end to end relationship along the support wire. The electrodes include exterior surfaces facing towards the bulb walls, and interior surfaces facing towards the support wire. Getters are mounted on the exterior surfaces, and mercury discharge units are mounted on the interior surfaces. The two electrode portions are non-overlapping along the support wire.

U.S. Pat. No. 6,064,155, granted May 16, 2000, to J. Maya, et al., discloses a compact fluorescent lamp that is designed to imitate an incandescent lamp in size, shape and luminosity. The lamp includes a bulbous envelope having an external shape of an incandescent lamp on a standard Edison-type base that enables it to be substituted for standard 60, 75 and 100 W. incandescent lamps. A low-pressure fluorescent lamp having a coiled tubular envelope with an outer diameter less than about 7 mm., an inner diameter between about 1 and 7 mm, and a length between about 50 and 100 cm. is wound in a coil around the axis of the bulbous envelope and is disposed within the bulbous envelope. The tubular envelope is formed of soft glass and has a fluorescent phosphor coating disposed on the inner surfaces. Electrodes with external electrical contacts are disposed at each end of the envelope. A ballast is disposed within the bulbous envelope. The ballast is electrically connected to the lamp, whereby to control current in the fluorescent lamp. A heat shield is disposed between the lamp and the ballast to thermally isolate the lamp from the ballast, whereby heat from the lamp will not adversely affect the ballast.

U.S. Pat. No. 6,515,433, granted Feb. 4, 2003, to S. Ge, et al., discloses where the sputtering of the cathodes of a cold cathode fluorescent lamp is reduced or eliminated by removing electrodes altogether from the sealed envelope containing the gaseous medium. Electric field is then applied by means of electrically conductive members outside the tube. Alternatively, the current passing between electrodes can be spread over multiple sub-electrodes so that the current flow and sputtering experienced by each individual sub-electrode will be reduced. Different designs are employed to facilitate heat dissipation for high power and high intensity cold cathode fluorescent lamp applications. Thus, a container for the fluorescent lamp tube may be omitted altogether and adjacent rounds of a spiral-shaped lamp may be attached together by an adhesive material. Alternatively, the container may be open at one end to facilitate heat dissipation. Or the container for the lamp and the housing from the driver tray each contain a hole to allow air circulation to carry away heat.

U.S. Pat. No. 6,646,365, granted Nov. 11, 2003, to C. J. M. Denissen, et al., teaches of a low-pressure mercury-vapor discharge lamp that has a discharge vessel filled with mercury and an inert gas. Electrodes in the discharge space have electrode shields, which operate at temperatures above 450° C. An inner surface of the electrode shield may have a heat-absorbing coating, for example a carbon film. The electrode shield may be supported by a support wire, at least a part of which is made from stainless steel. A lamp according to the invention has comparatively low mercury consumption.

Therefore, what is needed is a CCFL containing a gas absorbing alloy in its light tube that has an improved capability of absorbing oxygenic gas which can result in a lower operating temperature that will increase the life span of the cathode of a CCFL.

It is therefore an object of the present invention is to provide a light tube for a cold cathode fluorescent lamp that includes a zirconium-aluminum-based gas absorber, which is able to be activated at an activation temperature substantially lower than 900 degrees Celsius and has better efficiency of gas absorption than conventional ones.

It is another object of the present invention to provide a light tube for a cold cathode fluorescent lamp that includes a zirconium-aluminum based gas absorber, which is able to be activated at an activation temperature about 390 degrees Celsius, that is during the general gas discharging step of its manufacturing process, so as to minimize its manufacturing processes and cost and to eliminate those expensive heating equipments It is still another object of the present invention to provide a light tube for a cold cathode fluorescent lamp whose cathode is made in various shapes for enlarging a surface area of the cathode in order to enhance the cathode in terms of resisting oxidation and surviving an impact force applied to the light tube.

It is still yet another object of the present invention to provide a light tube for a cold cathode fluorescent lamp that is made in various shapes in order to reduce a space occupied by the same.

It is yet still another object of the present invention to provide a cold cathode fluorescent lamp that includes a housing air-tightly attached to an igniter casing extended from a base for maintaining heat therein in order to warm the cathode.

An additional object of the present invention is to provide a cold cathode fluorescent lamp that includes a housing attached to an igniter casing extended from a base, wherein an air passage is formed between the housing and the igniter casing for balancing pressure within and without the housing.

Yet, another object of the present invention is to provide a cold cathode fluorescent lamp that includes an igniter for driving the cold cathode to a functioning stage.

A final object of the present invention is to provide a cold cathode fluorescent lamp that includes a housing envelope made of colors for effects of colorful illumination.

In order to accomplish the above objectives, the present invention provides a light tube for a cold cathode fluorescent lamp comprising: a light tube body, having a first end portion and second end portion, containing an inert gas, a mercury substance and a phosphor coating layer on an inner surface of the light tube body; an anode, disposed at the first end portion in the light tube body, is adapted for connecting to a positive terminal of electricity; a cathode, disposed at the second end portion in the light tube body, is adapted for electrically connecting to the negative terminal for emitting electrons to excite the mercury substance for conducting the electrons to the anode as a electric loop, wherein the excited mercury substance emits ultra violet rays causing the phosphor coating to generate visible light; and a gas absorber, made of zirconium-aluminum alloy, formed at the cathode for absorbing oxygenic gas.

These and other objects, features, and advantages of the present invention will become apparent from reading the following detailed description, the accompanying drawings, and the appended claims.

SUMMARY OF THE INVENTION

The one phenomenon that causes a cold cathode fluorescent lamp to decay over time is its inherent problem with oxidation. Other than containing an inert gas and mercury, the light tube always contains a small amount of air that was either residually left in the light tube, or was introduced subsequently as a result of a seal failure. During the manufacturing process, gases such as $O_2$, CO, $CO_2$ and $H_2O$, may have been present in the light tube and such residual active gases would facilitate the oxidation of the cold cathode. This oxidation decreases the intensity of electrons emitted from the cold cathode, thereby reducing the luminance of the CCFL. When the oxidation level reaches a certain point, the cold cathode can no longer emit electrons with enough intensity to excite the mercury. At this point, the CCFL can no longer serve its purpose of illumination.

To cope with this problem of oxidation, one method employed is to place a gas absorber in the light tube to absorb the oxygenic gas. The less the oxygenic gas exists in the light tube, the slower the cold cathode oxidizes, which results in the cold cathode being able to emit electrons with sufficient intensity longer. Hence, the life span of the CCFL is therefore increased.

For example, a conventional color display may adopt a cathode partially coated with a layer of gas absorbent based upon an alloy of barium; and the filament of an electric light bulb may contain a gas absorber having phosphor as its predominating constituent; and some high-end products of CFL may include a gas absorber made of an alloy containing zirconium and aluminum. These various types of gas absorbers serve the same purpose of absorbing oxygenic gas in order to lengthen the life span of the lights.

One shortcoming of the conventional gas absorber is its insufficient capability of absorbing the oxygenic gas. The gas absorber usually performs at an activation temperature as high as 900 degrees Celsius. The high activation temperature works in both ways. Although it helps the absorber to absorb the oxygenic gas, it facilitates the oxidizing reaction of the cathode.

However, it also requires additional expensive manufacturing equipment to activate the gas absorber at 900 degrees Celsius, because a high temperature is required to form the activated gas absorber in order to absorb oxygenic gas at normal temperature. As a result, the cost of manufacturing the CCFL is invariably increased due to the fact that the processing of making the same is likewise complex.

BRIEF DESCRIPTION OF THE DRAWINGS

The present invention is pictorially illustrated in the accompanying drawings that are attached herein.

DETAILED DESCRIPTION OF THE INVENTION

Figure 1:
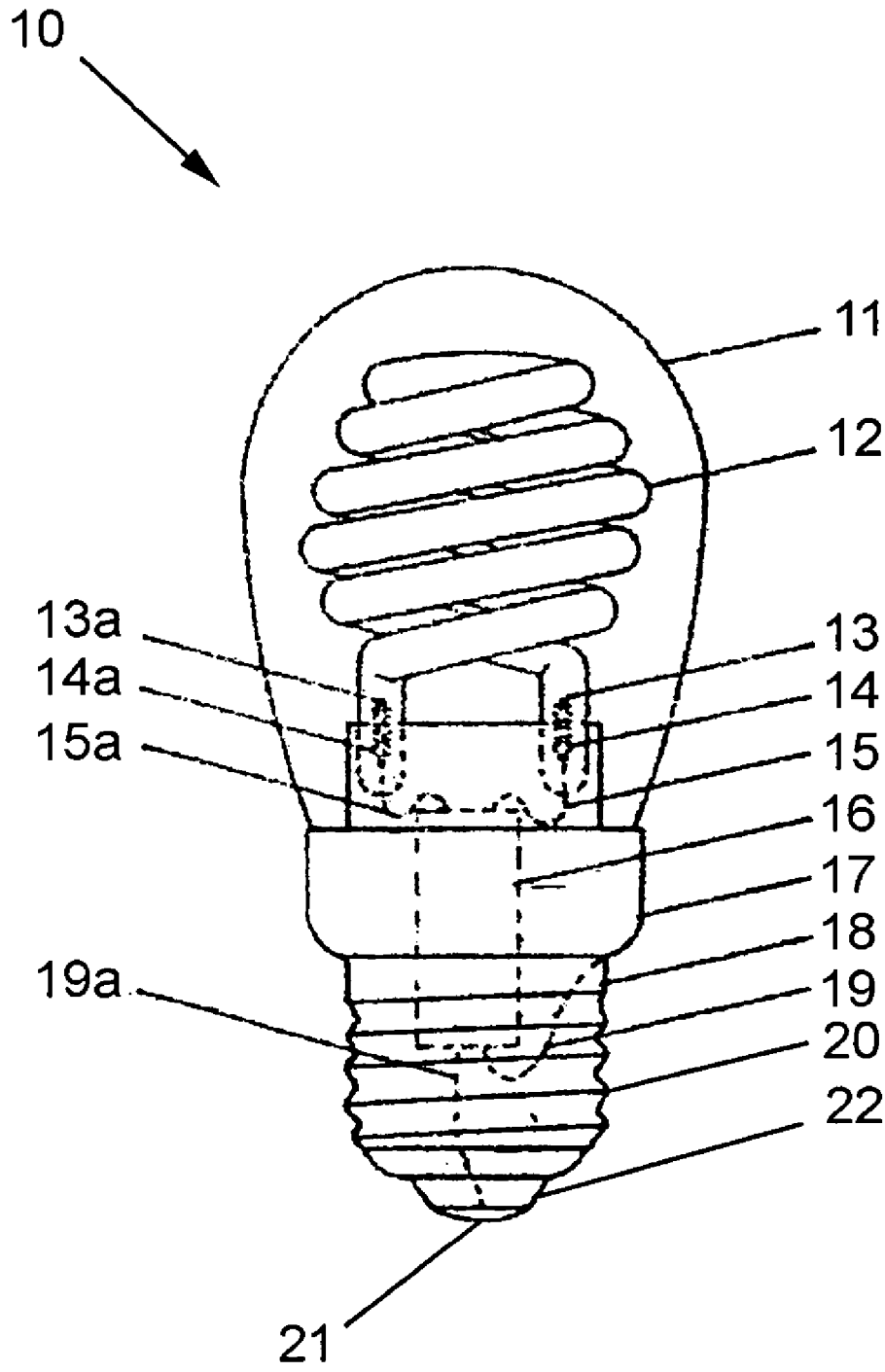
FIG. 1 is a side elevational view of a cold cathode fluorescent lamp that includes an improved gas absorber in its light tube in accordance with the preferred embodiment of the present invention.

FIG. 1 is a side view of a cold cathode fluorescent lamp, a CCFL that includes a gas absorber in accordance with the preferred embodiment of the present invention. The CCFL 10 is comprised of a base 18, an igniter casing 17 that extends from the base 18, an igniter 16 disposed in the igniter casing 17, electrodes including a cathode 13 and an anode 13*a*, activated gas absorbers 14 and 14*a*, a light tube 12 containing the electrodes 13 and 13*a*, and a housing envelope 11 attached to the igniter casing 17 for enclosing the light tube 12 therein.

The base 18 is comprised of a threaded sidewall connector 20, having a cylindrical shape, and an electrical foot contact 21, adapted for securing to a compatible socket for electrically connecting to an electric power source. The threaded sidewall connector 20 and the electrical foot contact 21 are made of conductive material for electrically connecting to the socket. The threaded sidewall connector 20 and electrical foot contact 21 are so insulated by insulator 22 that they may electrically be connected to a shell terminal and a center terminal of a medium base Edison socket, respectively.

The igniter casing 17 extends from the base 18, in which a cavity is formed for receiving various components. The igniter casing 17 is made integrally with the base 18 for ease of manufacturing. It is noted that the casing 17 may also be made separately from the base 18, and then attached thereto via traditional connection means.

The igniter 16, which is disposed in the igniter casing 17 for transforming voltage to a sufficient level to drive the cathode 13 and anode 13*a* electrodes to function, is electrically connected to the electrical foot contact 21 and the screw threaded sidewall connector 20 of the base 18 via the first wire 19 and the second wire 19*a*, respectively. When the base 18 is secured when a switch is turned on, connecting the igniter 16 to the electrical source of power. The igniter 16 is further electrically connected to the electrodes 13 and 13*a* by second wires 15 and 15*a* extending into the light tube.

The light tube 12 has a spiral shape with two end portions horizontally extending toward the igniter casing 17. The spiral shape minimizes the space the light tube 12 occupies so that the CCFL light bulb can be made compact. The light tube 12, having a phosphor coating spread on its inner surface, contains an inert gas, such as neon, argon, and mercury substance. The mercury substance may be in various forms, such as mercury vapor, liquid mercury or an amalgam.

The electrodes 13 and 13*a*, disposed at the end portions of the light tube 12, are each electrically connected, respectively, to the negative terminal and positive terminal of the igniter 16 via the second wires 15 and 15*a*. From the input terminals of the igniter 16, a first wire 19 is connected to the screw threaded sidewall connector 20 and a second wire 19*a* is connected to the electrical foot contact 21 of the base 18.

More particularly, one of the electrodes is the cathode 13, which is electrically connected to the negative terminal of the igniter 16, and the other, is the anode 13*a*, which is electrically connected to the positive terminal of the igniter 16, to form a completed electrical circuit. When the circuit is switched on, the igniter 16 boosts the voltage of the electric current received via the connecting wires 19 and 19*a* to excite the cathode 13 to emit electrons. The electrons emitting from the cathode 13 further excite the mercury contained in the light tube 12 to discharge electrons, thereby conducting the electric current to the anode 3*a*. In the course of mercury discharge, ultra violet rays are emitted to cause the phosphor coating to generate visible light.

The gas absorbers 14 and 14*a* are activated gas absorbers formed at the ends of electrodes 13 and 13*a* connecting to the second wires 15 and 15*a* to absorb oxygenic gas, such as $O_2$, CO, $CO_2$ and $H_2O$.

The gas absorbers are made of an alloy containing zirconium and aluminum, of whom were activated during the manufacturing process. Heating at an activation temperature of about 390 degrees Celsius forms the gas absorbers 14 and 14*a*. After cooling, the activated gas absorbers 14 and 14*a* are now capable of absorbing oxygenic gases at normal temperature.

In other words, no additional expensive heating equipment is required to form and activate the zirconium-aluminum gas absorbers 14 and 14*a*, where the traditional barium-based gas absorbers are required to be treated at substantially higher temperatures, i.e., 900 degrees Celsius. This advantage greatly saves the costs for manufacturing the CCFL and simplifies the manufacturing process, because no such additional components are required.

Moreover, the activated gas absorbers 14 and 14*a* provide stronger oxygenic gas absorption capability and render lower oxidizing rate of cathode 13 than the traditional ones. The activated gas absorbers 14 and 14*a* are capable of being made by various processes. For example, they may be coated with a layer of zirconium-aluminum alloy on the surfaces of electrodes 13 and 13*a*, by means of sputtering and disposition or they may be integrally formed with the electrodes 13 and 13*a* in its entirety.

The housing envelope 11, enclosing the light tube 12, is attached to the igniter casing 17 for protection of the same. The sealing between the housing envelope 11 and the igniter casing 17 may be air-tight such that the chances of air entering from outside the housing envelope 11 into the light tube 12 to fuel the cathode oxidation process is reduced. Accordingly, the housing envelope 11 is able to keep the light tube 12 warm, as it is functioning.

As an alternative, a gas passage may be formed between the interface of the housing envelope 11 and the igniter casing 17 in order to equalize the pressure within when used with the housing envelope 11. This reduces the probability that the housing envelope 11 may explode due to the imbalance of pressure. The housing envelope 11 may be colored red, green or blue (the three basic colors), or any other suitable color for purposes of colorful illumination. It should be noted that the housing envelope 11 could be made of any suitable material, such as, glass or plastic, to achieve the above-mentioned effects.

With reference now to FIGS. 2 through 7, variously shaped cathodes are shown.

Figure 2:
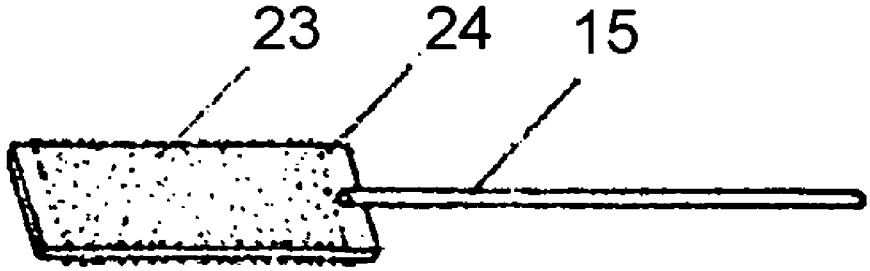
FIG. 2 is a perspective view of the cathode of the CCFL, shaped as a single layer plate on which the gas absorber is formed, which is in accordance with the preferred embodiment of the present invention.
Figure 3:
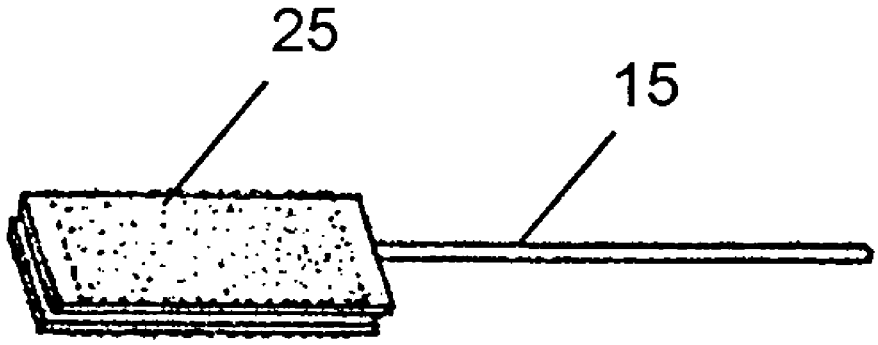
FIG. 3 is a perspective view of an alternative embodiment of the cathode of the CCFL, shaped as a plate with having two layers sandwiching a second wire, which is in accordance with the preferred embodiment of the present invention.

Turning now to FIG. 2, the cathode 23 is shaped as a single layer plate on which the gas absorber 24 is formed, and as an alternative, as shown in FIG. 3, the cathode 25 is shaped as two plates with two layers, where the second wire 15 is sandwiched between them.

Figure 4:
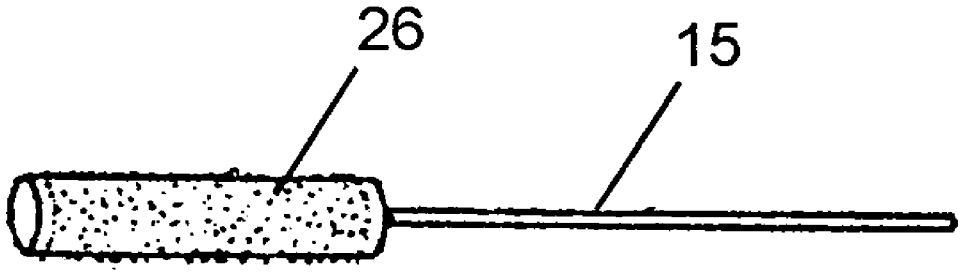
FIG. 4 is a perspective view of a second alternative embodiment of the cathode of the CCFL, shaped as a rod with a second wire attached to its end, which is in accordance with the preferred embodiment of the present invention.

There is shown in FIG. 4, a second alternative embodiment, where the cathode 26 is shaped as a rod, having the second wire 15 attached to its end.

Figure 5:
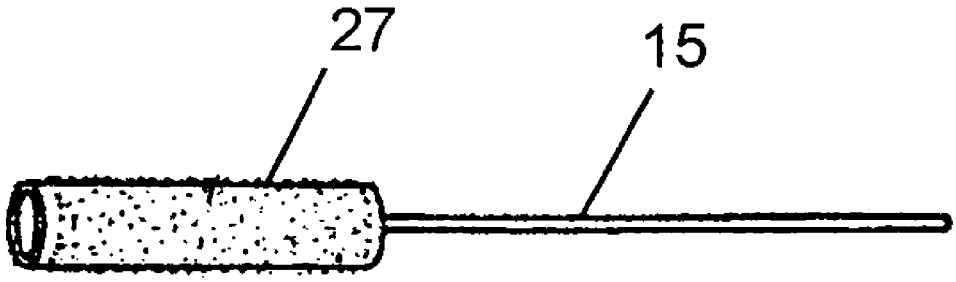
FIG. 5 is a perspective view of a third alternative embodiment of the cathode of the CCFL, shaped as a tube having a cylindrical sidewall to which a second wire is attached, which is in accordance with the preferred embodiment of the present invention.

FIG. 5, shows a third alternative embodiment, where the cathode 27 is made as a tube having a cylindrical sidewall defining an inner hollow portion to the end of which the second wire 15 is attached.

Figure 6:
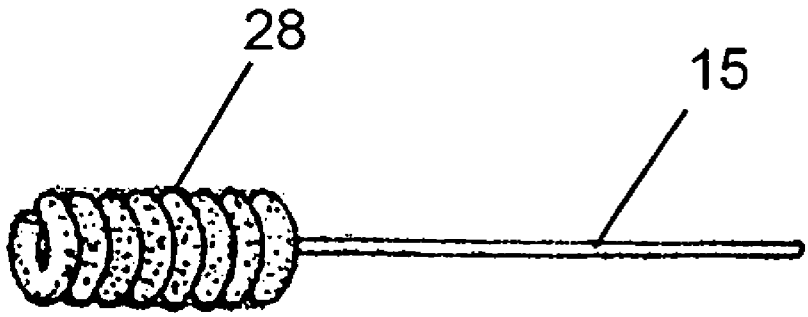
FIG. 6 is a perspective view of a fourth alternative embodiment of the cathode of the CCFL, shaped in the form of a spiral, having a constant cross-section, whose end is attached a second wire, in accordance with the preferred embodiment of the present invention.

In FIG. 6, a fourth alternative embodiment, the cathode 28 is shaped as a spiral that has a constant cross-section along the longitudinal direction to the end of which the second wire 15 is attached.

Figure 7:
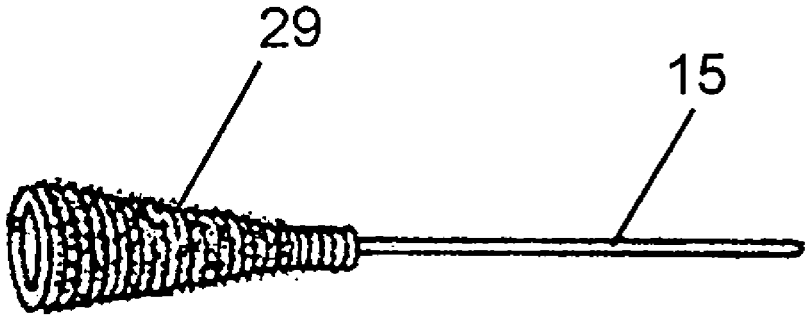
FIG. 7 is a perspective view of a fifth alternative embodiment of the cathode of the CCFL, shaped in the form of a spiral, having a varying cross-section, whose end is attached a second wire, in accordance with the preferred embodiment of the present invention.

In viewing FIG. 7, a fifth alternative embodiment, the cathode 29 is shaped as a spiral that has a cross-section varying along the longitudinal direction to the end of which the second wire 15 is attached.

The various shapes of cathodes described herein (cathodes 25 through 29), serve to function by enlarging the surface area of each of the cathodes to improve the electron emission for exciting the mercury contained in the light tube 12 and in light tubes 30 through 33. Additionally, the enlarged surface area makes the cathode less susceptible to oxidation than the conventional wire-shaped cathodes, because of their rather small surface areas. Furthermore, the various shapes enhance the cathodes capability of surviving an impact force and still yet maintain their structures intact.

Turning now to FIGS. 8 through 11, various shapes of light tubes are illustrated.

Figure 8:
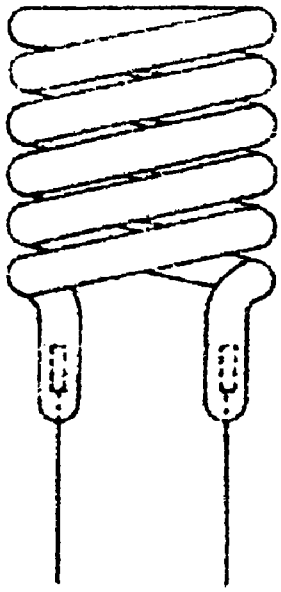
FIG. 8 is a perspective view of the light tube of the CCFL, shaped as a spiral, having a constant cross-sectional area, in accordance with the preferred embodiment of the present invention.

There is shown in FIG. 8, the light tube 30 shaped as a spiral having a constant cross-sectional area along its longitudinal direction.

Figure 9:
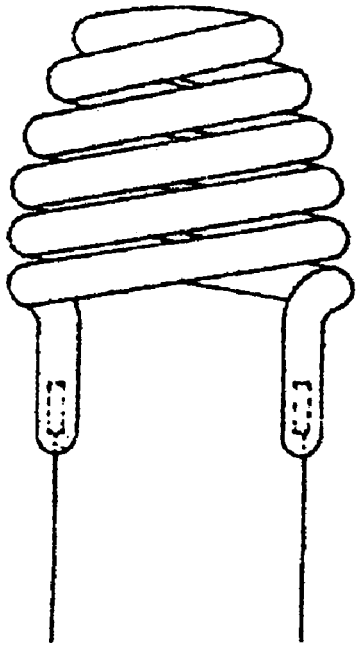
FIG. 9 is a perspective view of a second alternative embodiment of the light tube of the CCFL, shaped as a spiral, and having a wider bottom tapering vertically to the top, that is in accordance with the preferred embodiment of the present invention.

In FIG. 9, a second alternative embodiment relating to the light tube, the light tube 31 is shaped as a spiral having a wider bottom tapering vertically to the top.

Figure 10:
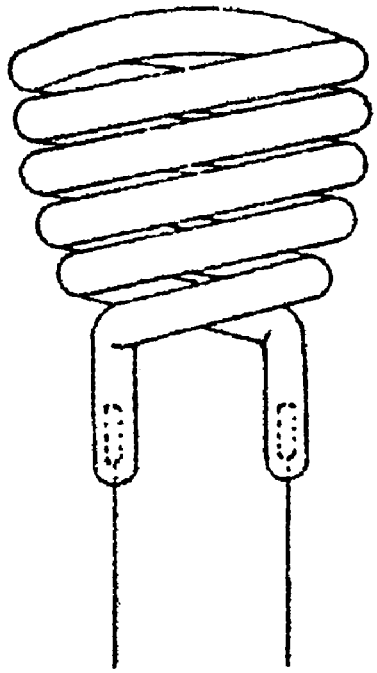
FIG. 10 is a perspective view of a third alternative embodiment of the light tube of the CCFL, shaped as a spiral, and having a wider top tapering vertically to the bottom, that is in accordance with the preferred embodiment of the present invention.

FIG. 10, a third alternative embodiment relating to the light tube, the light tube 32 is shaped as a spiral with a wider top tapering vertically to the bottom.

Figure 11:
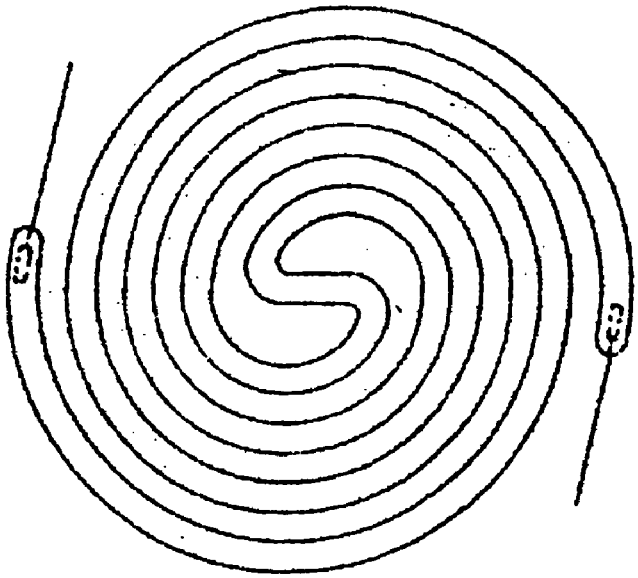
FIG. 11 is a perspective view of a fourth alternative embodiment of the light tube of the CCFL, where the light tube is in the shape of a flattened coil, in accordance with the preferred embodiment of the present invention.

Illustrated in FIG. 11 is a forth alternative embodiment relating to the light tube, where the light tube 33 is made in the shape of a flattened coil, on plan view.

The various shapes light tubes disclosed herein, reduce the space occupied by the light tube 12 and light tubes 30 through 33, thereby making the CCFL compact. Additionally, the light tubes disclosed herein can be transparent, milky or sand-polished for various effects of illumination.

One skilled in the art will understand that the embodiment of the present invention as shown in the drawings and described above is exemplary only and not intended to be limiting. It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the claims contained herein.

I claim:

1. A light tube for a cold cathode fluorescent lamp, comprising:

a light tube body, having a first end portion and second end portion, containing an inert gas, a mercury substance and a layer of phosphor coated on an inner surface of said light tube body;

an anode, disposed at said first end portion in said light tube body, adapted for connecting to a positive terminal of electricity;

a cathode, disposed at said second end portion in said light tube body, adapted for electrically connecting to said negative terminal for emitting electrons to excite said mercury substance for conducting said electrons to said anode as an electric loop, wherein said excited mercury substance emits ultra violet rays causing said phosphor coating to generate visible light; and wherein said cathode is coated with a gas absorber comprising a zirconium-aluminum alloy with oxygen absorption properties that slows an oxidizing decay rate of the cathode, enables activation of the gas absorber at an activation temperature lower than 900 degrees Celsius, and increases useful life of the cathode.

2. The light tube, as recited in claim 1, wherein said activated gas absorber is made from a zirconium-aluminum gas absorber which is activated at an activation temperature of about 390 degrees Celsius.

3. The light tube, as recited in claim 2, wherein said cathode is shaped as a single layer plate on which the gas absorber is formed for enlarging a surface area of said cathode in order to enhance said cathode in terms of resisting oxidation and surviving an impact force applied to said light tube.

4. The light tube, as recited in claim 2, wherein said cathode is shaped as a two-layer plate having two layers sandwiching a second wire, for enlarging a surface area of said cathode in order to enhance said cathode in terms of resisting oxidation and surviving an impact force applied to said light tube.

5. The light tube, as recited in claim 2, wherein said cathode is shaped as a tube having a cylindrical side wall to which a second wire is attached, said cylindrical side wall defining an inner hollow portion in order to enhance said cathode in terms of resisting oxidation and surviving an impact force applied to said light tube.

6. The light tube, as recited in claim 2, wherein said cathode, with its end attached to a second wire, is shaped as a spiral, which has a constant cross-section along a longitudinal direction of said cathode in order to enhance said cathode in terms of resisting oxidation and surviving an impact force applied to said light tub.

7. The light tube, as recited in claim 2, wherein said cathode, with its end attached to a second wire, is shaped as a spiral that has a cross-section varying along a longitudinal direction of said cathode in order to enhance said cathode in terms of resisting oxidation and surviving an impact force applied to said light tube.

8. The light tube, as recited in claim 2, wherein said light tube is shaped as a spiral with a constant area of cross-section along a longitudinal direction of said light tube in order to reduce a space occupied by said tube.

9. The light tube, as recited in claim 2, wherein said light tube is shaped as a spiral with a wider top tapering vertically to a bottom of said light tube in order to reduce a space occupied by said tube.

10. The light tube, as recited in claim 2, wherein said light tube is shaped as a spiral with a wider bottom tapering vertically to a top of said light tube in order to reduce a space occupied by said tube.

11. The light tube, as recited in claim 2, wherein said light tube is shaped as a flattened, coplanar coil in order to reduce a space occupied by said tube.

12. The light tube, as recited in claim 2, wherein said cathode is shaped as a rod with a second wire attached to its end, for enlarging a surface area of said cathode in order to enhance said cathode in terms of resisting oxidation and surviving an impact force applied to said light tube.

13. A cold cathode fluorescent lamp for illumination, comprising:

a housing;

a base for supporting said housing, having a positive terminal and a negative terminal insulated from said positive terminal for electrically connected to voltage;

a light tube, disposed in said housing, having a first end portion and a second end portion, wherein said light tube contains an inert gas, a mercury substance and a layer of phosphor coated on an inner surface thereof;

an anode, disposed at said first end portion in said light tube, electrically connecting to said positive terminal;

a cathode, disposed at said second end portion in said light tube, electrically connecting to said negative terminal for emitting electrons to excite said mercury substance for conducting said electrons to said anode as an electric loop, wherein said excited mercury substance emits ultra violet rays causing said phosphor coating to generate visible light; and an activated gas absorber, made of zirconium-aluminum alloy, formed at said cathode for absorbing oxygenic gas.

14. The cold cathode fluorescent lamp, as recited in claim 13, wherein said activated gas absorber is made from a zirconium-aluminum gas absorber which is activated at an activation temperature of lower than 900 degrees Celsius.

15. The cold cathode fluorescent lamp, as recited in claim 14, wherein said activated gas absorber is made from a zirconium-aluminum gas absorber which is activated at an activation temperature of about 390 degrees Celsius.

16. The cold cathode fluorescent lamp, as recited in claim 15, further comprising an igniter casing extending from said base and supporting said housing.

17. The cold cathode fluorescent lamp, as recited in claim 16, further comprising an igniter, which is disposed in said igniter casing, electrically connected to said positive terminal and said negative terminal, for driving said cathode to function.

18. The cold cathode fluorescent lamp, as recited in claim 17, wherein said housing is air-tightly attached to said igniter casing for maintaining heat therein in order to warm said cathode.

19. The cold cathode fluorescent lamp, as recited in claim 17, further comprising an air passage for balancing pressure within and without said housing in order to reduce a risk of explosion for said same.

* * * * *